US011205545B2

(12) United States Patent
Gruszeninks et al.

(10) Patent No.: US 11,205,545 B2
(45) Date of Patent: Dec. 21, 2021

(54) ELECTROMECHANICAL SWITCH WITH MANUAL SWITCHING OPTION

(71) Applicant: BERKER GmbH & Co. KG, Schalksmühle (DE)

(72) Inventors: Johann Gruszeninks, Rastatt (DE); Martin Engels, Lüdenscheid (DE); Christian Fa, Werdohl (DE)

(73) Assignee: BERKER GmbH & Co. KG, Schalksmühle (DE)

( * ) Notice: Subject to any disclaimer, the term of this patent is extended or adjusted under 35 U.S.C. 154(b) by 0 days.

(21) Appl. No.: 16/626,903

(22) PCT Filed: Jul. 5, 2018

(86) PCT No.: PCT/EP2018/068203
§ 371 (c)(1),
(2) Date: Dec. 27, 2019

(87) PCT Pub. No.: WO2019/011768
PCT Pub. Date: Jan. 17, 2019

(65) Prior Publication Data

US 2020/0176199 A1 Jun. 4, 2020

(30) Foreign Application Priority Data

Jul. 10, 2017 (DE) ..... 102017115382.9

(51) Int. Cl.
*H01H 3/54* (2006.01)
*H01H 3/02* (2006.01)
(Continued)

(52) U.S. Cl.
CPC ..... *H01H 3/54* (2013.01); *H01H 3/02* (2013.01); *H01H 3/28* (2013.01); *H01H 9/02* (2013.01)

(58) Field of Classification Search
CPC .. H01H 3/54; H01H 3/02; H01H 3/28; H01H 23/30; H01H 23/003; H01H 71/10; H01H 50/326; H01H 13/568
See application file for complete search history.

(56) References Cited

U.S. PATENT DOCUMENTS 6,714,106 B1 3/2004 Czarnecki et al.
2004/0130456 A1* 7/2004 Wu ..... H05B 47/10 340/9.1

FOREIGN PATENT DOCUMENTS

| | | |
|---|---|---|
| DE | 10259605 | 3/2004 |
| EP | 2187419 | 5/2010 |
| EP | 2863404 | 4/2015 |

OTHER PUBLICATIONS

International Search Report dated Sep. 13, 2018.

* cited by examiner

*Primary Examiner* — Vanessa Girardi
(74) *Attorney, Agent, or Firm* — Ipsilon USA, LLP

(57) ABSTRACT

A mechanical switch (10), in particular a light switch and/or a roller shutter switch and/or thermostat switch is provided. The mechanical switch (10) has a switching contact assembly (20), in particular a monostable, bistable or tristable switching contact assembly (20), and a base carrier (40), in which the switching contact assembly (20) is received The base carrier (40) has a holding device (50) for receiving an electromechanical actuator unit (100), which is designed in such a way that an electromechanical actuator unit (100) received in the holding device (50) can be supplied with voltage for effecting a state change of the switching contact assembly (20) independently of an external mechanical action on an operating mechanism by means of the electromechanical actuator unit (100).

16 Claims, 10 Drawing Sheets

(51) Int. Cl.
*H01H 3/28* (2006.01)
*H01H 9/02* (2006.01)

ELECTROMECHANICAL SWITCH WITH MANUAL SWITCHING OPTION

RELATED APPLICATION

This application is a National Phase of PCT/EP2018/068203 filed on Jul. 5, 2018, which claims the benefit of priority from German Patent Application No. 10 2017 115 382.9, filed on Jul. 10, 2017, the entirety of which are incorporated by reference.

BACKGROUND

Field of the Invention

The invention relates to a mechanical switch, in particular a light switch and/or roller shutter switch and/or thermostat switch. The invention further relates to an electromechanical actuator unit for such a mechanical switch, a switch arrangement comprising such a mechanical switch and such an electromechanical actuation unit and a method for controlling a switch.

Description of Related Art

Mechanical switches of the type mentioned above are known from the area of electrical installation. When a user is to be provided with further functions, in particular electromechanical functions such as for example enabling the actuation of the switch from afar, the switch must normally be replaced with a switch with such a functionality. Examples of such switches are for example known from CN 202 871 661 U and DE 10 2015 010 820 A1.

Objects and Summary

It is the task of the present invention to provide a mechanical switch that can be extended by further functions (plug and play) in a simple way, i.e. without additional wiring effort.

To solve this task a mechanical switch of the type mentioned above is suggested, which comprises a switching contact assembly, in particular a monostable, bistable or tristable switching contact assembly and a base carrier, in which the switching contact assembly is received. The base carrier further comprises a guide means. The mechanical switch comprises an operating mechanism, which is guided in the guide means and is suitable for adopting an operating position following external mechanical action for effecting a state change of the switching contact assembly, and takes up a resting position in the absence of the external mechanical action. The base carrier further has a holding device for receiving an electromechanical actuator unit, wherein the holding device is designed in such a way that an electromechanical actuator unit received in the holding device can be supplied with voltage to effect a state change of the switching contact assembly by means of the electromechanical actuator unit independently of an external mechanical action on the operating mechanism.

This design allows the mechanical switch to be equipped with an actuator unit in a simple way, for example to effect a state change in the switching contact assembly from a distance.

The holding device preferably comprises a first plug-in connection means, which can be connected with a second plug-in connection means of the electromechanical actuator unit for supplying the electromechanical actuator unit received in the holding device with voltage, wherein the first plug-in connection means is preferably designed as a socket and the second plug-in connection means as a plug.

This design allows a simple connection of the actuator unit with the holding device for supplying the electromechanical actuator unit with voltage.

According to the invention the switching contact assembly is uncoupled from the operating mechanism when the operating mechanism adopts the resting position.

This design allows to effect a state change of the switching contact assembly by means of the electromechanical actuator unit in a simple way.

The guide means preferably has at least one linear guide element for a linear guiding of the operating mechanism and/or at least one rotary guide element for the rotatable guiding of the operating mechanism, wherein the linear guide element is further preferably designed as a slot open on one side or as an elongated hole and/or the rotational guide element is designed as an opening or blind hole with respective circular cross-sections.

This design allows the use different operating mechanisms for the mechanical switch.

In a preferred design the switching contact assembly has at least one rocker switch rotatably mounted in the base carrier and at least one first switching contact, wherein the rocker switch is suitable for adopting a first position, in which the rocker switch touches the first switching contact, and at least one neutral position, in which the rocker switch is located at a distance from the first switching contact.

The base carrier preferably comprises a guide arrangement and the switching contact assembly has a carriage that is mounted to move along and/or against a guiding direction in the guide arrangement, wherein the carriage is preferably suitable for adopting a neutral position, in which the carriage is mechanically uncoupled from the rocker switch.

This design further allows the mechanical switch to be operated by means of the operating mechanism even if an electromechanical actuator unit is received in the holding device.

In a preferred design the mechanical switch comprises at least one spring element, which is connected on the base carrier and the carriage in such a way that the spring element applies a force to the carriage, with which the carriage can be transferred from a first switching position and/or a second switching position and/or a first interim position and/or a second interim position into the neutral position.

The carriage preferably has a first target surface that is suitable for being brought into contact with a first tappet of a first actuator of the electromechanical actuator unit received in the holding device for moving the carriage along guide direction and effecting a state change of the switching contact assembly in this way.

In a preferred design the carriage has a second target surface, which is suitable for being brought into contact with a second tappet of a second actuator of the electromechanical actuator unit received in the holding device for displacing the carriage along guide direction and to effect a state change of the switching contact assembly in this way.

The first target surface and the second target surface are preferably designed in such a way that a successive movement of the first tappet and the second tappet effects a movement of the carriage from the neutral position into a first switching position.

A transfer of the switching contact assembly into the first switching condition is preferably effected during a movement of the carriage from the neutral position into the first switching position. The previously mentioned designs allow a reduction of the forces to be applied on the carriage by the electromechanical actuator unit for effecting a state change of the switching contact assembly.

In a preferred design the carriage has a third target surface, which is suitable for being brought into contact with the first tappet of the first actuator of the electromechanical actuator unit received in the holding device for moving the carriage against guide direction and thus effect a state change of the switching contact assembly.

The carriage preferably has a fourth target surface, which is suitable for being brought into contact with the second tappet of the second actuator of the electromechanical actuator unit received in the holding device for displacing the carriage against guide direction and thus effect a state change of the switching contact assembly.

In a preferred design the third target surface and the fourth target surface are designed in such a way that a successive movement of the second tappet and the first tappet effects a movement of the carriage from the neutral position into a second switching position.

These designs allow the switching mechanism to be transferred into a second switching position by means of the carriage and the electromechanical actuator unit when the carriage is moved from the neutral position into the second switching position.

An arrangement of the target surfaces described above determines the movement of the carriage, starting from neutral position, either in guide direction or against guide direction through the sequence of actuating the actuators. If the first actuator is actuated first and the second actuator second based on the neutral position of the carriage, this results in a movement of the carriage in guide direction into the first switching position, which transfers the switching contact assembly into the first switching position. If the second actuator is actuated first and the first actuator second based on the neutral position of the carriage, this results in a movement of the carriage against guide direction into the second switching position, which transfers the switching contact assembly into the second switching position.

The first target surface is preferably received at an oblique angle in relation to a movement direction of the first tappet of the electromechanical actuator unit received in the holding device and/or the second target surface is received at an oblique angle in relation to a movement direction of the second tappet of the electromechanical actuator unit received in the holding device and/or the third target surface is received at an oblique angle in relation to a movement direction of the first tappet of the electromechanical actuator unit received in the holding device and/or the fourth target surface is received at an oblique angle in relation to a movement direction of the second tappet of the electromechanical actuator unit received in the holding device.

This design allows the movement of the first tappet and/or the second tappet to effect a movement of the carriage in or against guide direction.

In a preferred design the switching contact assembly comprises at least one spring means and the rocker switch is further suitable for adopting a first tilt position, in which the rocker switch is located at a distance from the first switching contact, wherein the first tilt position is arranged between the first switching position and the neutral position, wherein the first tilt position constitutes a tilting point of the rocker switch, so that the spring means transfers the rocker switch into the first switching position when the rocker switch adopts a position between the first tilt position and the first switching position, and wherein the carriage is suitable for transferring the rocker switch from the neutral position in the direction of the first switching position and further than the first tilt position when the carriage is moved from the neutral position into a first switching position.

The rocker switch preferably comprises a protrusion and the carriage has a window, wherein the protrusion penetrates the window, wherein the protrusion can further preferably be brought into contact with a frame of the window for effecting a state change of the switching contact assembly.

This design allows a simple mechanical coupling of the rocker switch and the carriage.

In a preferred design the guide means and an actuation means of the first tappet and/or the second tappet intersect each other or guide direction and an actuation direction of the first tappet and/or the second tappet are crooked to each other, wherein the guide means preferably runs substantially orthogonal to the movement direction of the first tappet and/or orthogonal to the movement direction of the second tappet.

The carriage preferably comprises a blocking element, which is suitable for blocking the operating mechanism when the carriage lies outside of the neutral position.

This design allows it to prevent that the operating mechanism is operated whilst the state change of the switching contact assembly is effected by means of the electromechanical actuator unit.

In a preferred design the carriage comprises a first arresting means neighbouring the first target surface, which can be connected with a head of the first tappet for holding the carriage in a first interim position, wherein the first arresting means is arranged in such a way that the head of the first tappet is suitable for sliding along the first target surface up to the first arresting means in order to connect the head of the first tappet with the first arresting means in the first interim position. The first arresting means is preferably designed in such a way here that the head of the first tappet is held in the first arresting direction even when the first actuator is not powered up.

The first target surface, the second target surface and the first arresting means are preferably arranged and designed in such a way that a movement of the head of the first tappet up to the first arresting means effects a movement of the carriage from the neutral position into the first interim position, and a movement of the second tappet following this effects a disconnection of the connection between the head of the first tappet and the first arresting means and a movement of the carriage from the first interim position into a first switching position. The first arresting means is still preferably designed in such a way here that the first tappet of the non-powered first actuator is disconnected from the first arresting means when the carriage is transferred from the first interim position into the first switching position, which retracts the first tappet against the first movement direction.

A movement of the carriage from the first interim position into the first switching position preferably effects that the switching contact assembly adopts the first switching position.

In a preferred design the carriage comprises a second arresting means neighbouring the fourth target surface, which can be connected with a head of the second tappet for holding the carriage in a second interim position, wherein the second arresting means is arranged in such a way that the head of the second tappet is suitable for sliding along the fourth target surface up to the second arresting means for connecting the head of the second tappet with the second arresting means in the second interim position. The second arresting means is preferably designed in such a way here that the head of the second tappet in held in the second arresting means even when the second actuator is not powered up.

The fourth target surface, the third target surface and the second arresting means are preferably arranged and designed in such a way that a movement of the head of the second tappet up to the second arresting position effects a movement of the carriage from then neutral position into the second interim position, and a movement of the first tappet following this effects a disconnection of the connection between the head of the second tappet and the second arresting means and a movement of the carriage from the second interim position into a second switching position. The second arresting means is further preferably designed in such a way here that the second tappet of the non-powered second actuator is disconnected from the second arresting means when the carriage is transferred from the second interim position into the second switching position, which retracts the second tappet against the second movement direction.

In a further preferred design the base carrier further comprises a spring device and a rotatable abutment element, wherein the carriage is suitable for adopting a first switching position and a first interim position arranged between the neutral position and the first switching position, and the abutment element is suitable for adopting a starting position, a first rotation position, a second rotation position and a third rotation position, wherein the spring device applies a force onto the abutment element at least in part, wherein the abutment element, the spring device and the carriage are designed in such a way that the carriage can be transferred from the neutral position into the first interim position when the abutment element adopts the starting position, wherein the abutment element, the spring device and the carriage are designed in such a way that the abutment element is transferred from the neutral position into the first interim position during a movement of the carriage from the starting position into the first rotation position, wherein the abutment element forms an abutment for the carriage in the first interim position in the first rotation position, wherein abutment element, the spring device and the carriage are designed in such a way that the abutment element is transferred from the first interim position into the neutral position during a movement of the carriage from the first rotation position into the second rotation position, wherein the abutment element, the spring device and the carriage are designed in such a way that the carriage can be transferred from the neutral position into the first switching position when the abutment element adopts the second rotation position, wherein the abutment element, the spring device and the carriage are designed in such a way that the abutment element is transferred from the second rotation position into the third rotation position during a movement of the carriage from the neutral position into the first switching position, and wherein the abutment element, the spring device and the carriage are designed in such a way that the abutment element is transferred from the third rotation position into the starting position during a movement of the carriage from the first switching position into the neutral position.

The invention further relates to an electromechanical actuator unit for a mechanical switch according to the invention, wherein the electromechanical actuator unit is suitable for being received in the holding device of the mechanical switch for supplying the electromechanical actuator unit with voltage, and for effecting a state change of the switching contact assembly of the mechanical switch by means of the electromechanical actuator unit independently of an external mechanical action on the operating mechanism of the mechanical switch.

The electromechanical actuator unit preferably comprises a second plug-in connection means, which can be connected with a first plug-in connection means of the mechanical switch for supplying the electromechanical actuator unit received in the holding device with voltage, wherein the second plug-in connection is preferably designed as a plug.

This design allows a simple connection of the electromechanical actuator unit with the mechanical switch.

In a preferred design the electromechanical actuator unit comprises a first actuator with a first tappet, wherein the first tappet is designed for being brought into contact with a first target surface of the carriage for moving the carriage along the guide means and thus effect a state change of the switching contact assembly.

In a preferred design the electromechanical actuator unit comprises a second actuator with a second tappet, wherein the second tappet is designed for being brought into contact with a second target surface of the carriage for moving the carriage along guide direction and thus effect a state change of the switching contact assembly.

The first tappet is preferably designed for being brought into contact with a third target surface of the carriage for moving the carriage against guide direction and thus effect a state change of the switching contact assembly.

According to a further preferred design the second tappet is further designed for being brought into contact with a fourth target surface of the carriage for moving the carriage against guide direction and thus effect a state change of the switching contact assembly.

The first tappet is preferably moveable in a first movement direction and the second tappet in a second movement direction, wherein the first movement direction and the second movement direction extend coplanar, preferably parallel to each other.

The invention further relates to a switch assembly comprising a mechanical switch according to the invention and an electromechanical actuator unit according to the invention, wherein the electronic actuator unit is received in the holding device of the mechanical switch.

Lastly the invention relates to a method for controlling a switch, wherein the switch comprises a switching contact assembly, in particular a monostable, bistable or tristable switching contact assembly, a base carrier, in which the switching contact assembly is received, and an electromechanical actuator unit, wherein the base carrier comprises a holding device, in which the electromechanical actuator unit is received, wherein the electromechanical actuator unit comprises a first actuator with a first tappet and a second actuator with a second tappet, wherein the switching contact assembly has at least one rotatably mounted rocker switch and at least one first switching contact, wherein the base carrier further comprises a guide arrangement and the switching contact assembly comprises a carriage, which is mounted to move along and/or against a guide direction in the guide arrangement, wherein the carriage has a first target surface, which is suitable for being brought into contact with the first tappet of the first actuator of the electromechanical actuator unit received in the holding device, and wherein the carriage has a second target surface, which is suitable for being brought into contact with the second tappet of the second actuator of the electromechanical actuator unit received in the holding device, said method characterised by the following method steps:

Controlling the first actuator for bringing the first tappet into contact with the first target surface and for transferring the carriage along a guide direction from a neutral position into a first interim position and for effecting a transfer of the rocker switch from a neutral position into a first interim position;

controlling the second actuator for bringing the second tappet into contact with the second target surface and for transferring the carriage along a guide direction from the first interim position into a first switching position and for effecting a transfer of the rocker switch from the first interim position into a first switching position.

In a preferred design the switching contact assembly has at least a second switching contact, wherein the carriage has a third target surface, which is suitable for being brought into contact with the first tappet of the first actuator of the electromechanical actuator unit received in the holding device, and wherein the carriage has a fourth target surface, which is suitable for being brought into contact with the second tappet of the second actuator of the electromechanical actuator unit received in the holding device, wherein the method is characterised by the following further method steps:

Controlling the second actuator for bringing the second tappet into contact with the fourth target surface and for transferring the carriage against a guide direction from the neutral position into a second interim position and for effecting a transfer of the rocker switch from a neutral position into a second interim position;

controlling the first actuator for bringing the first tappet into contact with the third target surface and for transferring the carriage against guide direction from the second interim position into a second switching position and for effecting a transfer of the rocker switch from the second interim position into a second switching position.

In a preferred design the carriage comprises a first arresting means and/or a second arresting means, wherein the first tappet has a head and the second tappet has a head, wherein the method is characterised by the following further method steps:

Connecting the first arresting means with the head of the first tappet in the first interim position for holding the carriage in the first interim position and/or for holding the head of the first tappet in the first arresting means; and/or connecting the second arresting means with the head of the second tappet in the second interim position for holding the carriage in the second interim position and/or for holding the head of the second tappet in the second arresting means.

In a preferred design of the method the rocker switch is in contact with the first switching contact in the first switching position and is located at a distance from the first switching contact in the neutral position and/or the rocker switch is in contact with the second switching contact in the second switching position and located at a distance from the second switching contact in the neutral position and/or the carriage is mechanically uncoupled from the rocker switch in the neutral position.

BRIEF DESCRIPTION OF THE DRAWINGS

Details and further advantages of the mechanical switch according to the invention, the electromechanical actuator unit according to the invention, the switch assembly according to the invention and the method according to the invention for controlling a switch will be explained with the aid of four embodiment examples described below. In detail the following illustrate.

DETAILED DESCRIPTION

Figure 1:
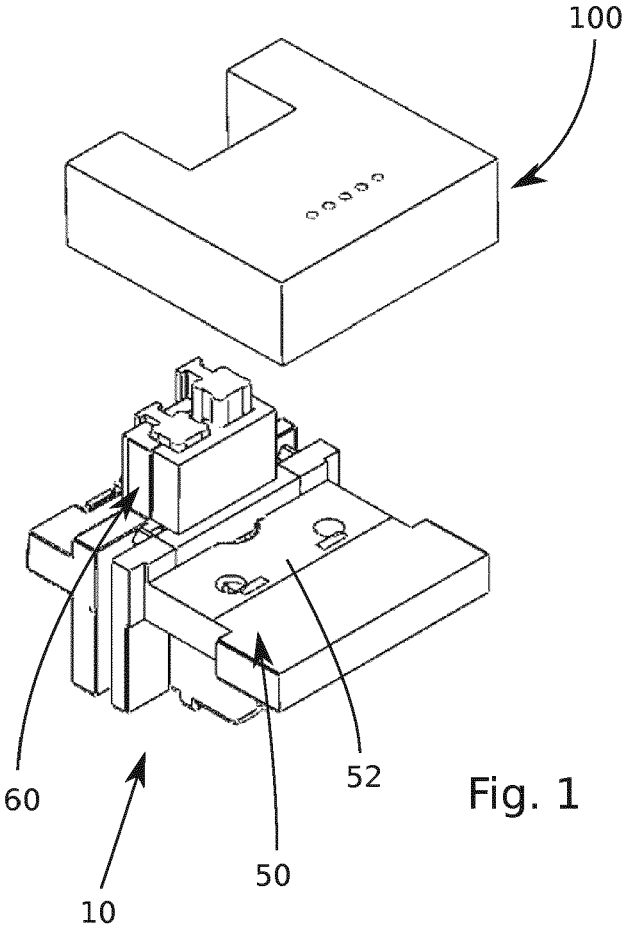
FIG. 1: a perspective view of a switch assembly according to the invention, comprising a mechanical switch according to the invention and an electromechanical actuator unit according to the invention according to a first embodiment example.
Figure 2:
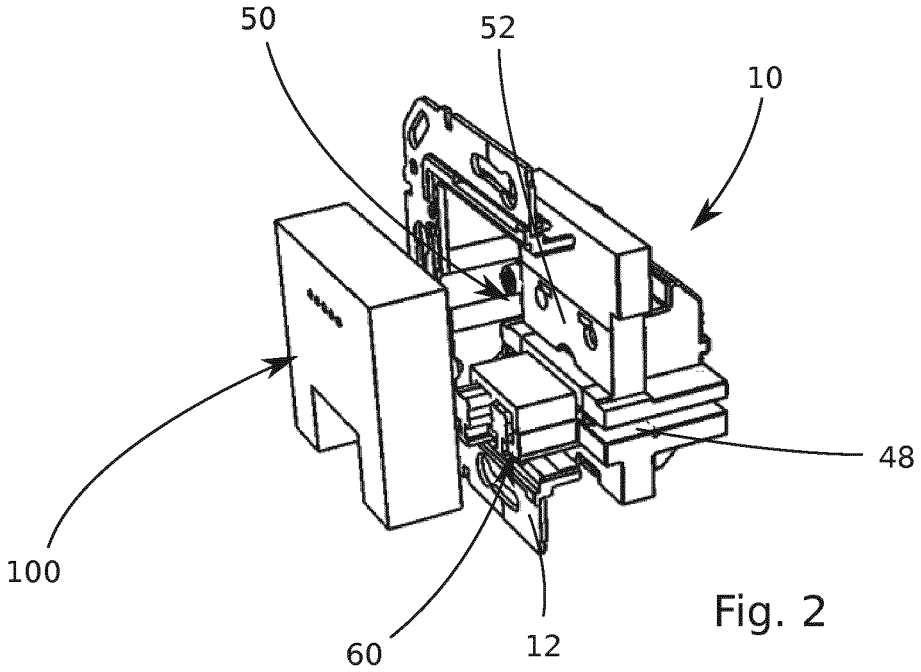
FIG. 2: shows a perspective view of the switch assembly according to the first embodiment example.
Figure 3:
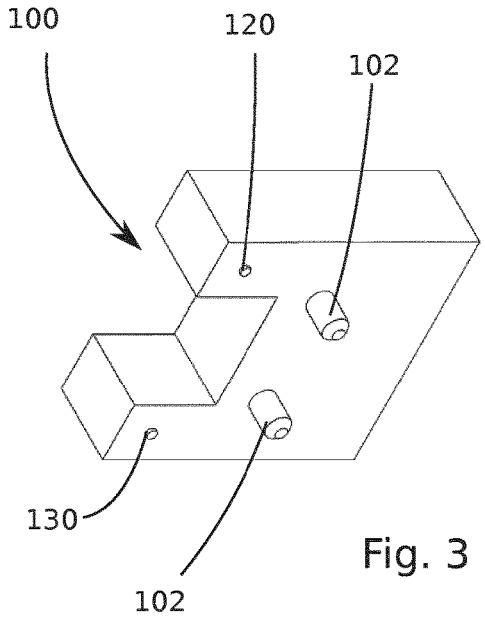
FIG. 3 a perspective view of the electromechanical actuator unit according to the first embodiment example.
Figure 4:
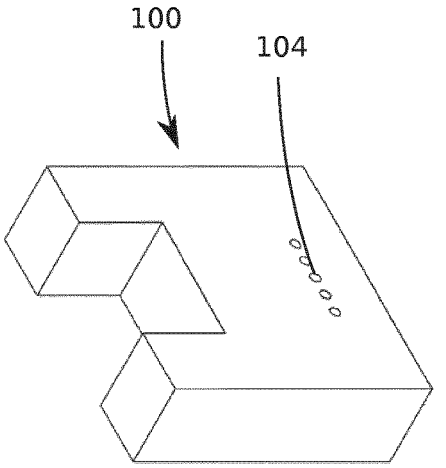
FIG. 4 a perspective view of the electromechanical actuator unit according to the first embodiment example.

The invention relates to a mechanical switch 10, in particular a light switch and/or a roller shutter switch and/or a thermostat switch. The mechanical switch 10 comprises a switching contact assembly 20, in particular a monostable, bistable of tristable switching contact assembly 20, and a base carrier 40, in which the switching contact assembly 20 is received. The base carrier 40 comprises a guide means 42. The mechanical switch 10 comprises an operating mechanism 60, which is held in the guide means 42 and is suitable for adopting an operating position B following external mechanical action for effecting a state change of the switching contact assembly 20, and to adopt a resting position R if the external mechanical action is absent. The base carrier 40 further has a holding device 50 for receiving an electromechanical actuator unit 100. The holding device 50 is designed in such a way that an electromechanical actuator unit 100 received in the holding device 50 can be supplied with voltage for effecting a state change of the switching contact assembly 20 by means of the electromechanical actuator unit 100 independently of an external mechanical action on the operating mechanism 60.

The switching contact assembly 20 can preferably adopt at least a first switching position SP1 and at least one neutral position NP.

The switching contact assembly 20 can have at least one rocker switch 22 rotatably mounted in the base carrier 40 and at least one first switching contact 24. In the first switching position SP1 the rocker switch 22 is in contact with the first switching contact 24. In the neutral position NP the rocker switch 22 is located at a distance from the first switching contact 24. The switching contact assembly 20 can further have a second switching contact 24*a*. The rocker switch 22 can be suitable for adopting a second switching position SP2 here, in which the rocker switch 22 is in contact with the second switching contact 24*a*. The switching contact assembly 20 can in particular be a tristable switching contact assembly 20.

In an embodiment example not depicted in the Figures the switching contact assembly 20 comprises two separate rocker switches 22, namely a first rocker switch and a second rocker switch, wherein the first rocker switch can preferably be transferred from the neutral position N into the first switching position S1 in a first switching position SP1 through a movement of the carriage 26, and the second rocker switch can be transferred from the neutral position N into the second switching position S2 in a second switching position SP2 through a movement of the carriage 26.

The holding device 50 can comprise a first plug-in connection means 52. The electromechanical actuator unit 100 can comprise a second plug-in connection means 102. The first plug-in connection means 52 can be connected with the second plug-in connection means 102 for supplying the electromechanical actuator unit 100 received in the holding device 50 with voltage. In the installed condition of the electromechanical actuator unit 100 in the holding device 50 the first plug-in connection means 52 is connected with the second plug-in connection 102. The first plug-in connection means 52 can preferably be designed as a socket, and the second plug-in connection means 102 can be designed as a plug. This is recognisable in particular from FIGS. 1 to 4.

The electromechanical actuator unit 100 can be designed in such a way that switching can take place independently of actuating the operating mechanism 60.

The switching contact assembly 20 can be uncoupled from the operating mechanism 60 when the operating mechanism 60 adopts the resting position R.

The operating mechanism 60 can be designed for continuing a switching process started by means of the actuators 120, 130, but not completed. In this way the function of the mechanical switch 10 can still be guaranteed if a fault occurs in the actuator unit 100.

Figure 12:
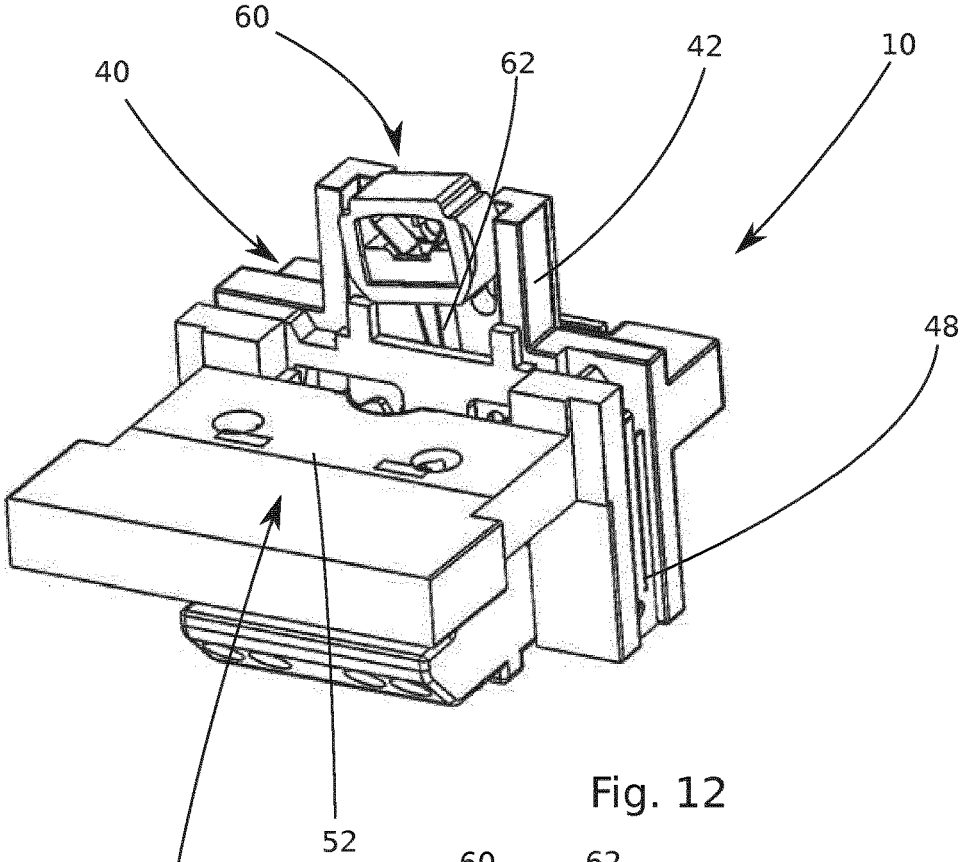
FIG. 12 a perspective view of the mechanical switch of FIG. 10.

The operating mechanism 60 according to the second embodiment example can comprise an actuating member 62, which is suitable for effecting a state change of the switching contact assembly 20 by acting upon the rocker switch 22. The actuating member 62 can either be a separate component here, in particular a metallic punched part or a bent punched part as reproduced in FIGS. 12 to 14, or can be formed as a single piece with the rest of the operating mechanism 60 (not illustrated in the Figures).

A free space for receiving the electromechanical actuator unit 100 is preferably located in the mechanical switch 10, which is further preferably outlined by the holding device 50.

The mechanical switch 10 can be designed in a way that the mechanical switching function can be carried out without an electromechanical actuator unit 100 being received in the holding device 50.

The mechanical switch 10 can be designed in such a way that the electromechanical actuator unit 100 can be inserted into the holding device 50 in an installed condition of the mechanical switch 10 or in a removed condition of the mechanical switch 10. In a preferred design the electromechanical actuator unit 100 can be pushed onto the mechanical switch 10 from the front, which means from a direction that equals an installation direction of the mechanical switch 10.

Figure 5:
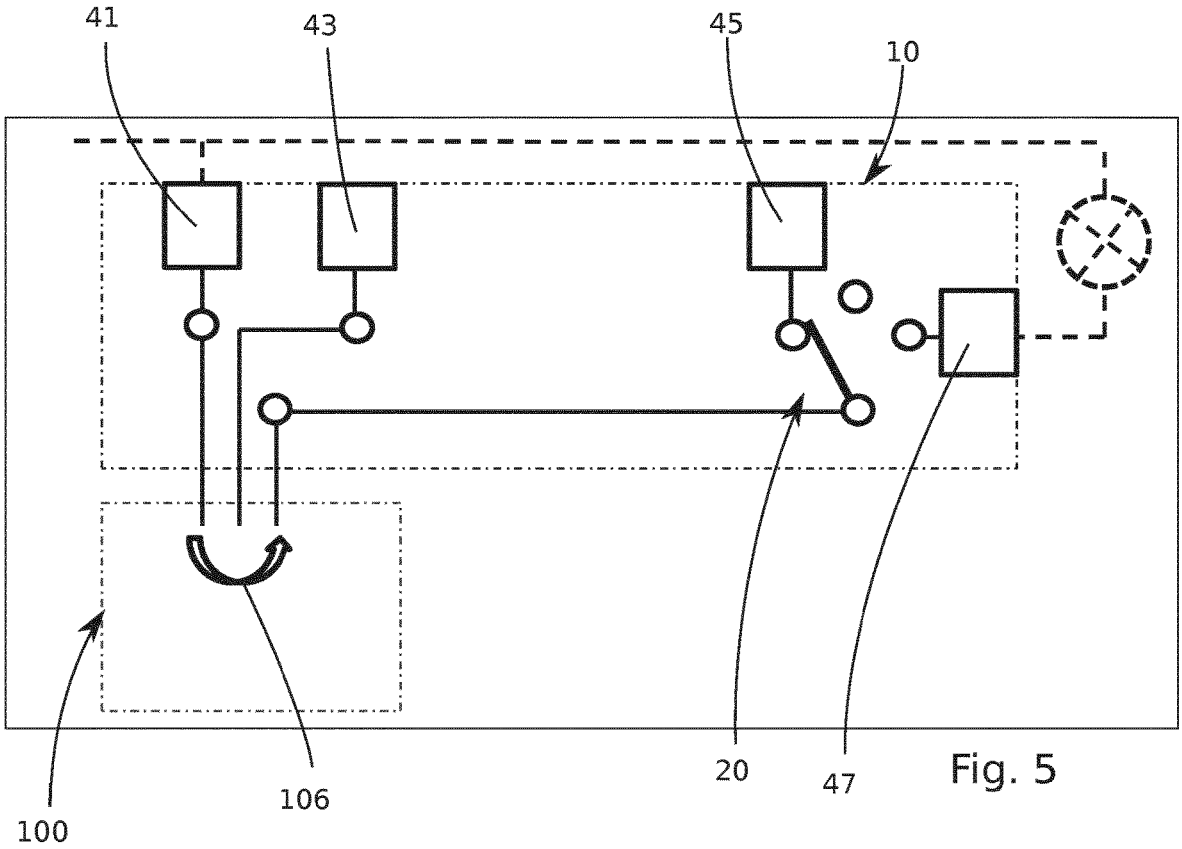
FIG. 5 a schematic illustration the switch assembly according to the first embodiment example.

The mechanical switch 10 can comprise connection clamps 41, 43, 45, such as in particular disclosed in FIG. 5. The connection clamps 41, 43, 45 are preferably arranged in the base carrier 40.

The electromechanical actuator unit 100 can comprise a contact bridge 10, which serves for producing an electric connection between the connection clamp 41 and/or the connection clamp 43 and the switching contact assembly 20 when the electromechanical actuator unit 100 is received in the holding device 50.

Figure 6:
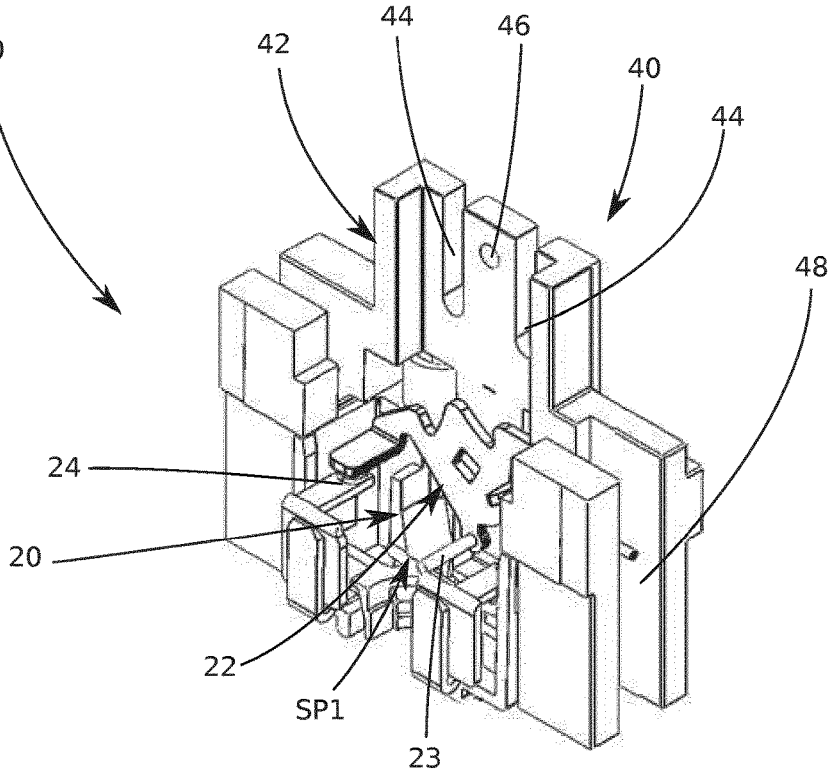
FIG. 6 a perspective view of the mechanical switch of the switch assembly according to the first embodiment example.
Figure 7:
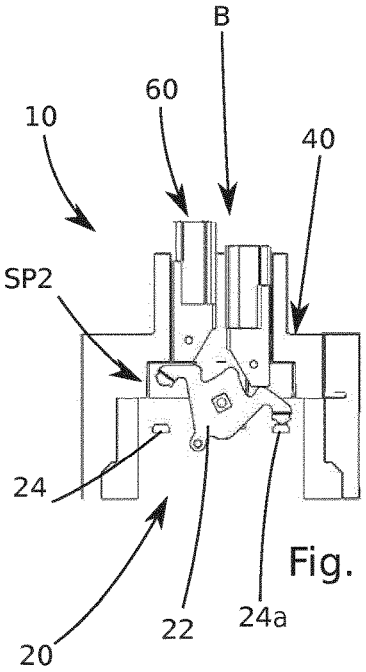
FIGS. 7 to 9 a side section view of the mechanical switch of FIG. 6.
Figure 8:
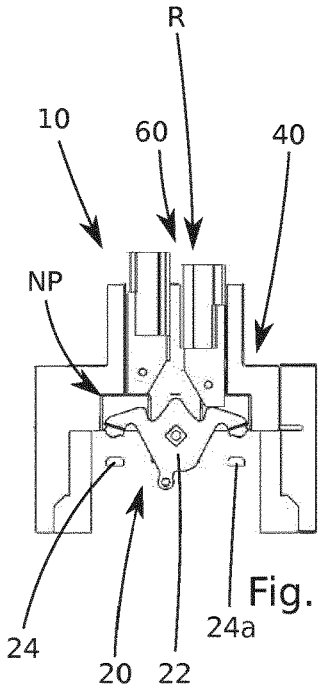
Figure 9:
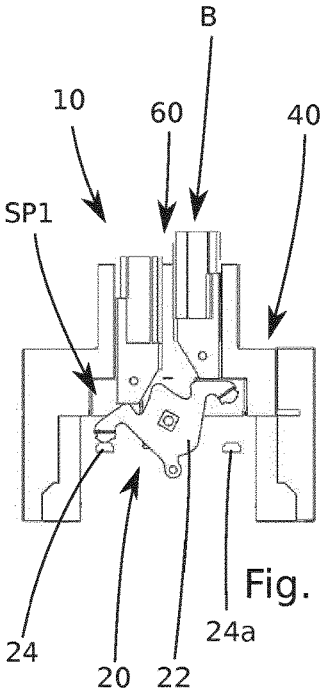
Figure 10:
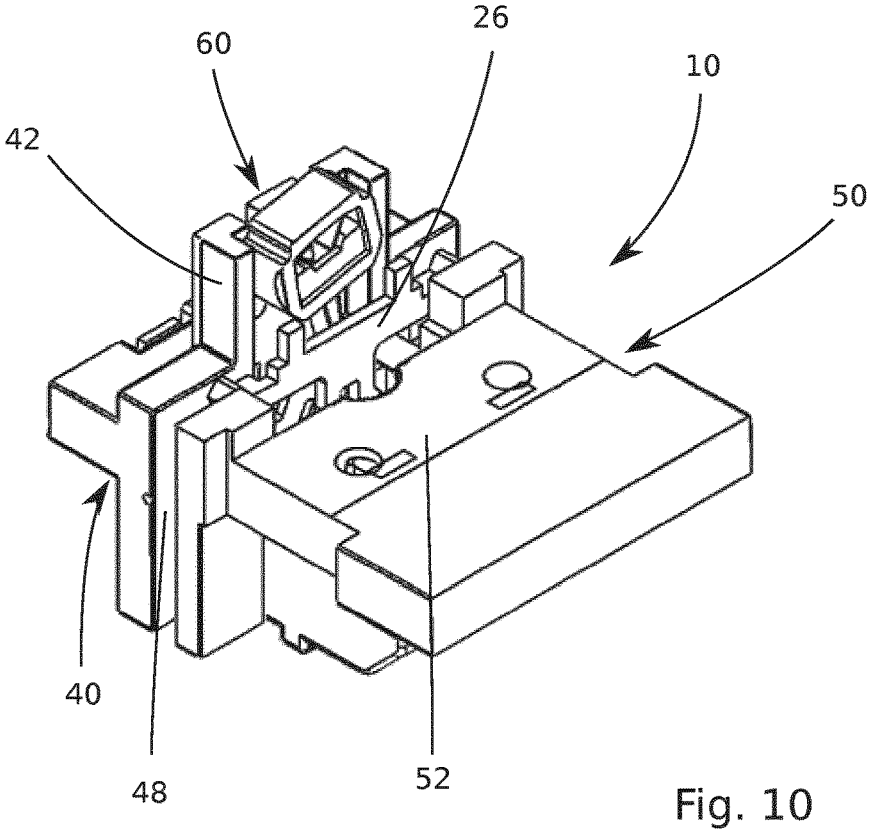
FIG. 10 shows the perspective view of a mechanical switch of a switch assembly according to a second embodiment example.
Figure 11:
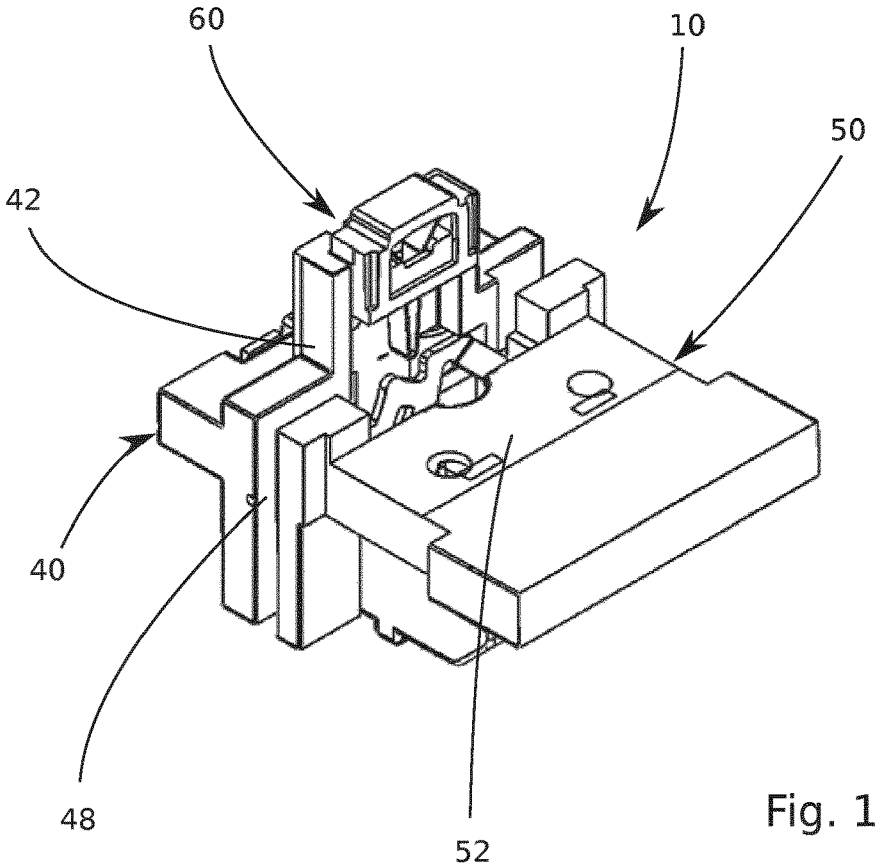
FIG. 11 shows a perspective view of a mechanical switch of a switch assembly according to a third embodiment example.

In a preferred design, which is in particular apparent from FIG. 6, the guide means 42 comprises at least one linear guide element 44 for the linear guiding of the operating mechanism 60. According to the embodiment example of FIG. 6 the guide means 42 can comprise two linear guide elements 44. Alternatively or additionally the guide means 42 can comprise at least one rotatory guide element 46 for a rotational guiding of the operating mechanism 60. This is also in particular apparent from FIG. 6. A rotatory guiding of the operating mechanism 60 by means of the rotatory guide element 46 is in particular envisaged for the second embodiment example of the switch assembly reproduced in FIGS. 12 to 15.

In a preferred design the operating mechanism 60 has a stroke that is smaller than approx. 8 mm, preferably smaller than approx. 4 mm, more preferably smaller than 2.5 mm.

The same base carrier 40 can be designed for receiving various operating mechanisms 60 in order to enable various applications of the mechanical switch 10.

The linear guide element 44 can preferably be designed as a slot open at one side or an elongated hole and/or the rotatory guide element 46 can be designed as an opening or a blind hole with respective circular cross-sections. This is also in particular apparent from FIG. 6.

The base carrier 40 can further comprise a guide arrangement 48 and the switching contact assembly 20 can comprise a carriage 26. The carriage 26 can be mounted in the guide arrangement 48 to move along and/or against a guide direction F. The carriage 26 can be suitable for adopting a neutral position N, in which the carriage 26 is mechanically uncoupled from the rocker switch 22. The carriage 26 can further adopt a first switching position S1, in which the carriage 26 mechanically acts on the rocker switch 22 in such a way that the rocker switch 22 is transferred into the first switching position SP1. The carriage 26 can further be suitable for adopting a second switching position S2, in which the carriage 26 mechanically acts on the rocker switch 22 in such a way that the rocker switch 22 adopts the second switching position SP2.

The carriage 26 can be manufactured from a metallic material. The carriage 26 can be designed as a punched sheet metal part or as a bent sheet metal part. The carriage 26 can have a consistent thickness.

In a preferred design the mechanical switch 10 comprises at least one spring element 28, which is connected with the base carrier 40 and the carriage 26 in such a way that the spring element 28 applies a force to the carriage 26, with which the carriage 26 can be transferred from a first switching position S1 and/or a second switching position S2 and/or a first interim position Z1 and/or a second interim position Z2 into the neutral position N. The spring element 28 is in particular reproduced in FIG. 13.

The carriage 26 is preferably transferred into the neutral position N when neither of the two actuators 120, 130 is activated. The transfer of the carriage 26 into the neutral position N further preferably takes place by means of at least one spring element 28.

The spring element 28 can be designed as a leaf spring. The spring element 28 can be designed as a single piece with the carriage 26. The spring element 28 can consist of a punched sheet metal part or a bent sheet metal part together with the carriage 26.

The carriage 26 can comprise two spring elements 28 in total, wherein each of the spring elements 28 is preferably fitted at one end of the carriage 26. The spring element 28 can be connected with the base carrier 40 by means of a screw connection or a rivet connection or by beading. To simplify the illustration the connection between the spring element 28 and the base carrier 40 in not illustrated in the Figures.

To be able to effect a displacement of the carriage 26 along or against guide direction F the carriage 26 can be equipped with a plurality of target surfaces 30, 32, 34, 36. A first target surface 30 can be designed to be brought into contact with a tappet 122 of a first actuator 120 here for moving the carriage 26 along guide direction F. The carriage can further be equipped with a second target surface 32, which is suitable for being brought into contact with a second tappet 132 of a second actuator 130 for displacing the carriage 26 along guide direction F. Displacing the carriage 26 along guide direction F can effect a state change of the switching contact assembly 20, in particular to a first switching position SP1.

The first target surface 30 and the second target surface 32 can be designed in such a way here that a successive movement of the first tappet 122 and the second tappet 132 (in this order) effects a movement of the carriage 26 from the neutral position N into the first switching position S1.

The carriage can have a third target surface 34, which is suitable for being brought into contact with the first tappet 122 of the first actuator 120 for moving the carriage 26 against guide direction F and thus effect a state change of the switching contact assembly 20. The carriage 26 can further have a fourth target surface 36, which is suitable for being brought into contact with the second tappet 132 of the second actuator 130 for displacing the carriage 26 against guide direction F and thus effect a state change of the switching contact assembly 22. The third target surface 34 and the fourth target surface 36 can be designed in such a way here a successive movement of the second tappet 132 and the first tappet 122 (in this order) effects a movement of the carriage 26 from neutral position N into a second switching position S2.

The target surfaces 30, 32, 34, 36 can each be arranged oblique-angled in relation to a movement direction M1, M2 of the respective tappet 122, 133. In this way a movement of the tappets 122, 132 in their respective movement direction M1, M2 can be transformed into a movement of the carriage 26 in or against guide direction F.

The switching contact assembly 20 can further comprise a spring means that is connected with the rocker switch 22. The spring means can further be fitted on the base carrier 40.

The rocker switch 22 can adopt a first tilt position and a second tilt position, in which the respective rocker switch 22 of the first switching contact 24 and/or the second switching contact 24*a* is located at a distance. The first tilt position is preferably arranged between the first switching position SP1 and the neutral position NP. The second tilt position can be arranged between the second switching position SP2 and the neutral position NP. The first tilt position and the second tilt position can each constitute a tilt point of the rocker switch 22. The spring means transfers the rocker switch 22 into the first switching position here when the rocker switch adopts a position between the first tilt position and the first switching position. The second tilt position can preferably constitute a tilt point of the rocker switch, so that the spring means transfers the rocker switch 22 into the second switching position SP2 when the rocker switch 22 adopts a position between the first tilt position and the second switching position SP2. The carriage 26 can be designed to transfer the rocker switch 22 from the neutral position NP in the direction of the first switching position SP1 and further than the first tilt position here when the carriage is moved from the neutral position N into the first tilt position S1. The carriage 26 can further be suitable for transferring the rocker switch 22 from the neutral position in the direction of the second switching position SP2 and further than the second tilt position when the carriage 26 is moved from the neutral position N into a second switching position S2.

Figure 13:
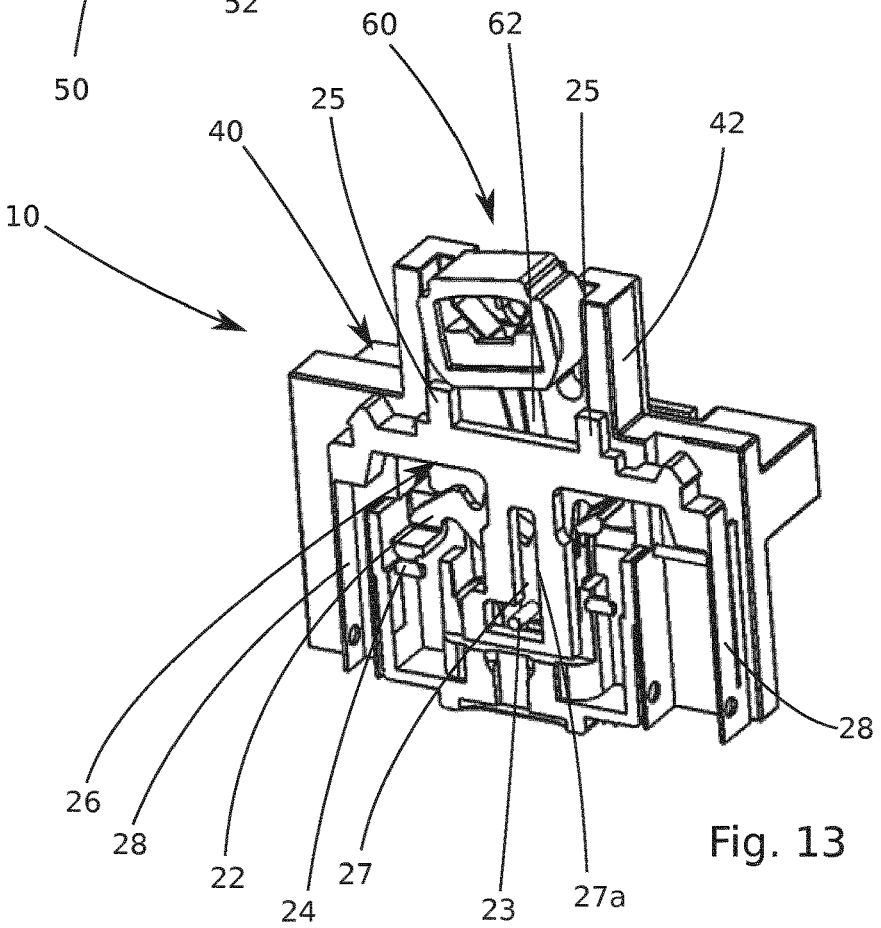
FIG. 13 a perspective section view of the mechanical switch of FIG. 10.
Figure 14:
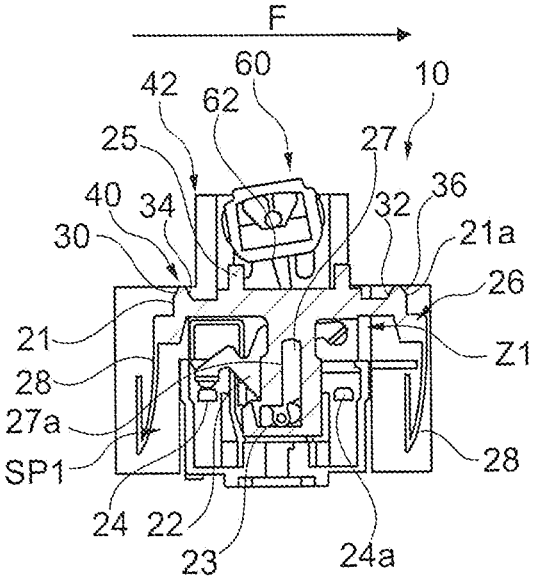
FIG. 14 shows a side section view of the mechanical switch of FIG. 10.
Figure 15:
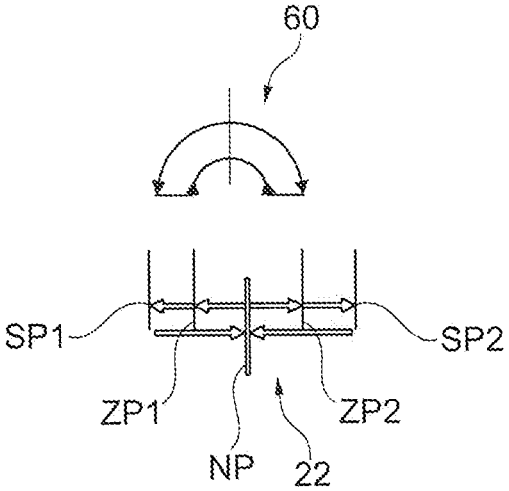
FIG. 15 shows a diagram of the various switching and interim positions that the switching mechanism of the mechanical switch of the mechanical switch of FIG. 14 can adopt.

As is particularly apparent from FIG. 13 the rocker switch 22 can comprise a protrusion 23 and the carriage 26 can have a window 27. The protrusion 23 can penetrate the window 27 here. The protrusion 23 can preferably be brought into contact with a frame 27*a* of the window 27 for effecting a state change of the switching contact assembly 22.

Figure 16:
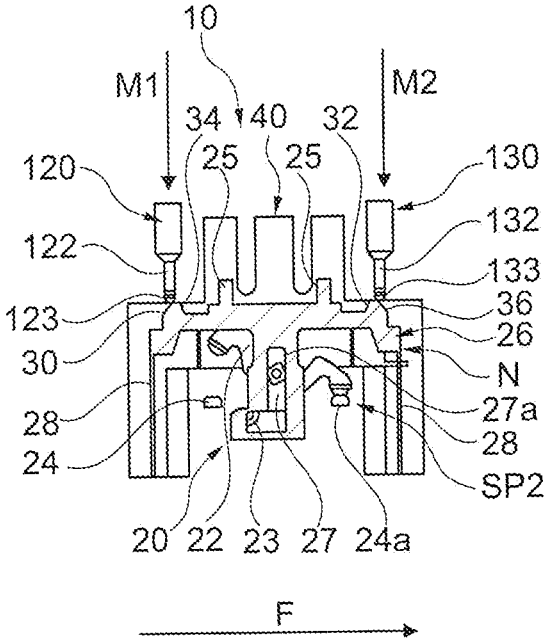
FIG. 16 shows a side section view of the mechanical switch of FIG. 6.
Figure 17:
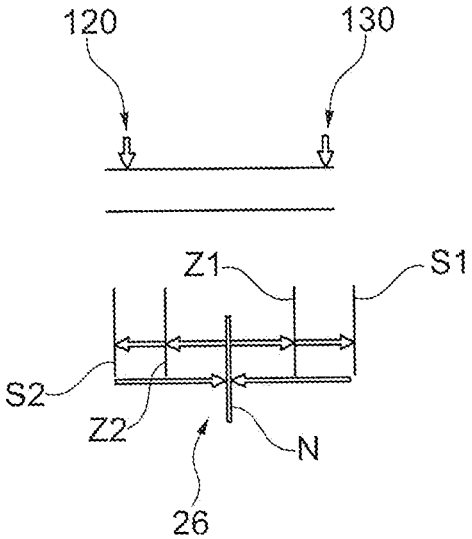
FIG. 17 shows a diagram of the various switching and interim positions that the switching mechanism of the mechanical switch of FIG. 16 can adopt.
Figure 18:
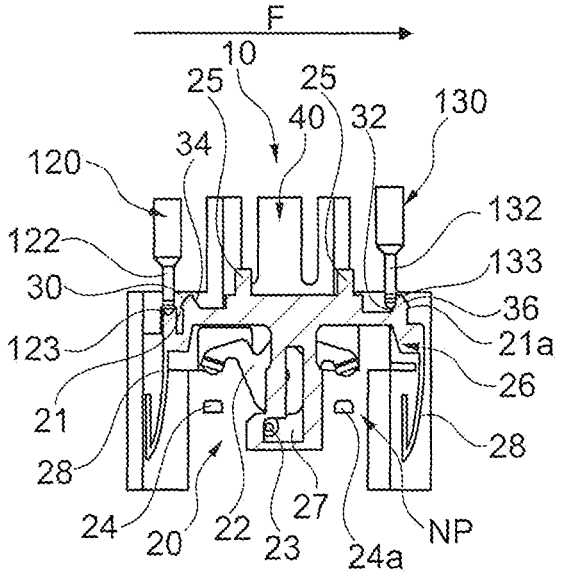
FIG. 18 shows a side section view of the mechanical switch of FIG. 10.
Figure 19:
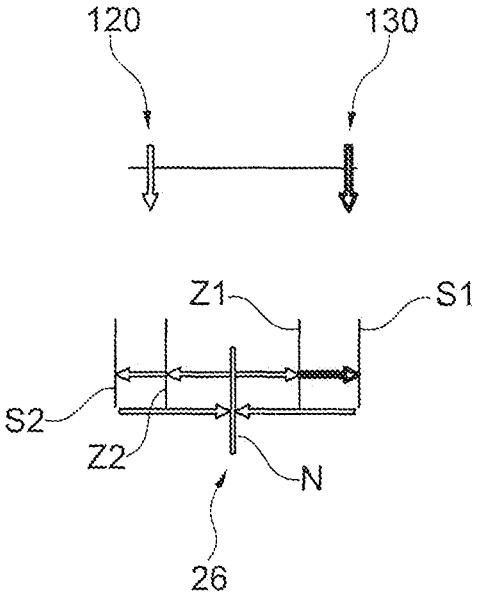
FIG. 19 shows a diagram of the various switching and interim positions that the switching mechanism of the mechanical switch of FIG. 18 can adopt.
Figure 20:
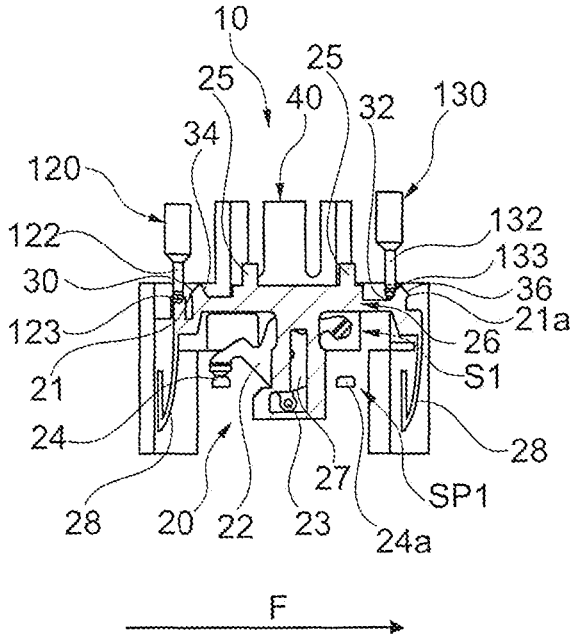
FIG. 20 shows a side section view of the mechanical switch of FIG. 10.
Figure 21:
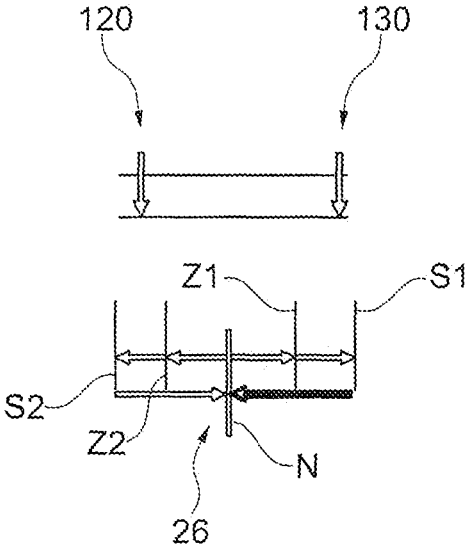
FIG. 21 shows a diagram of the various switching and interim positions that the switching mechanism of the mechanical switch of FIG. 20 can adopt.
Figure 22:
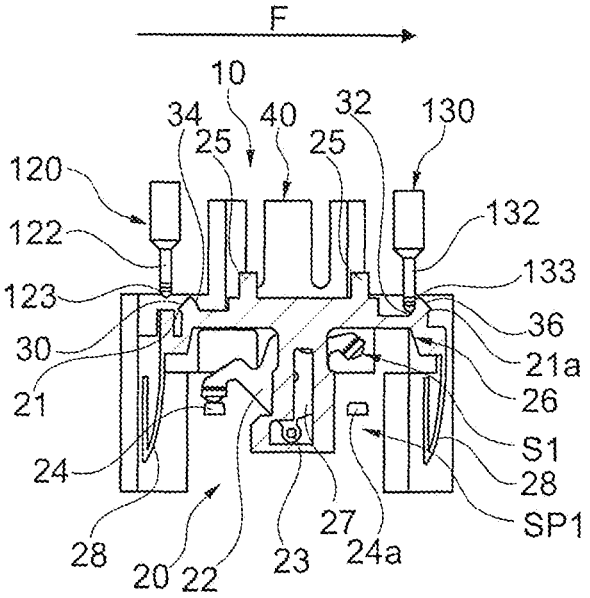
FIG. 22 shows a side section view of the mechanical switch of FIG. 10.
Figure 23:
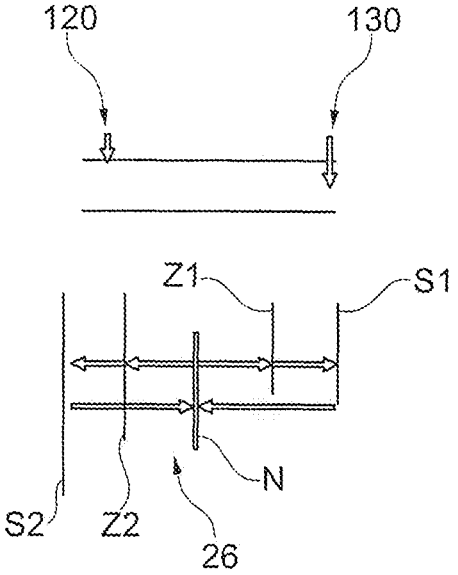
FIG. 23 shows a diagram of the various switching and interim positions that a switching mechanism of the mechanical switch of FIG. 22 can adopt.
Figure 24:
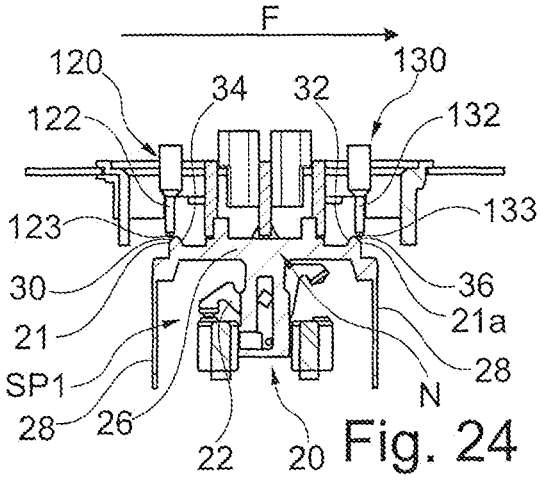
FIGS. 24 to 29 show the mechanical switch of FIG. 6 with various switching positions of the switching contact assembly and various positions of the carriage.
Figure 25:
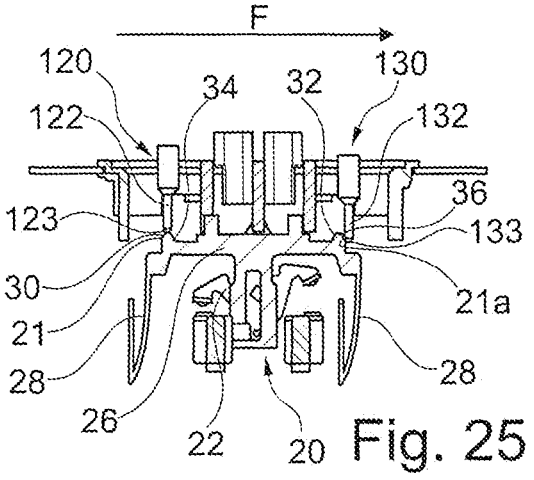

Guide direction F and a movement direction M1 of the first tappet 122 can intersect each other or be crooked in relation to each other. Guide direction F and a movement direction M2 of the second tappet 132 can intersect each other or be crooked in relation to each other. Guide direction F preferably runs substantially orthogonal to the movement direction M1 of the first tappet 122 and/or orthogonal to the movement direction M2 of the second tappet 132. The design is in particular apparent from FIG. 16.

The carriage 26 can comprise a blocking element 25, preferably two blocking elements 25. The blocking element 25 is suitable for blocking the operating mechanism 60 when the carriage 26 lies outside of neutral position N.

An external mechanical actuation of the operating mechanism 60 can therefore be suppressed when one of the actuators 120, 130 is activated for effecting a state change of the switching contact assembly 20.

The blocking element 25, or the two blocking elements 25, is preferably designed and arranged in such a way that a switching process started by the electromagnetic actuator unit 100 can be completed by the operating mechanism 60, whilst a switching process in the opposite direction can be prevented.

The carriage 26 can comprise a first arresting means 21 adjacent to the first target surface 30, which can be connected with the head 123 of the first tappet 122 for holding the carriage 26 in a first interim position Z1. The first target surface 30 preferably transforms into the first arresting means 21 here. The arresting means 21 can be arranged on the carriage 26 in such a way here that the head 123 of the first tappet 122 is suitable for sliding along the first target surface 30 up to the first arresting means 21 for connecting the head 123 of the first tappet 122 with the first arresting means 21 in the first interim position Z1.

The carriage 26 can have a second arresting means 21*a* adjacent to the second target surface 32, which can be connected with a head 133 of the second tappet 132 for holding the carriage 26 in a second interim position Z2. The second target surface 32 can open into the second arresting means 21*a* here. The second arresting means 21*a* can be arranged in such a way that the head 133 of the second tappet 132 is suitable for sliding along the second target surface 32 up to the second arresting means 21*a* for connecting the head 133 of the second tappet 132 with the second arresting means 21*a* in the second interim position Z2.

Figure 26:
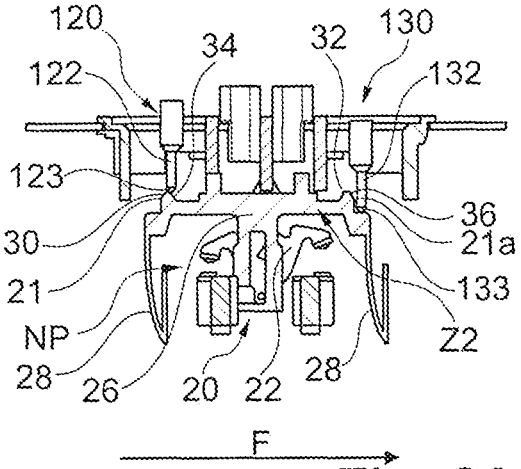
Figure 27:
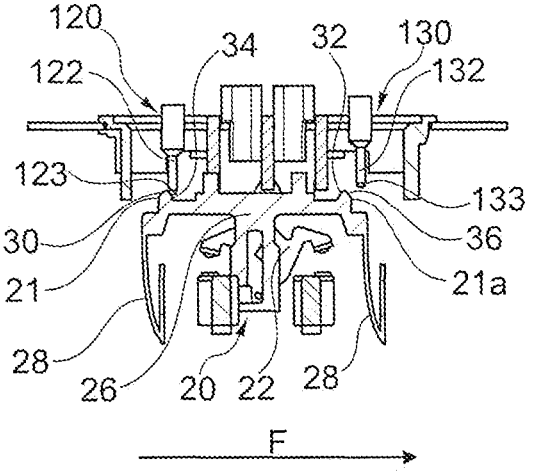
Figure 28:
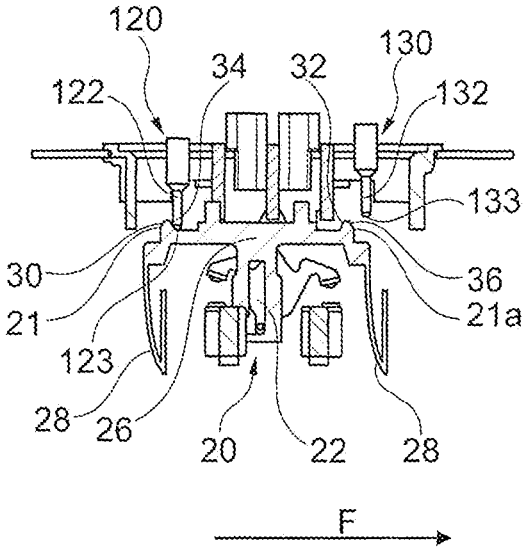
Figure 29:
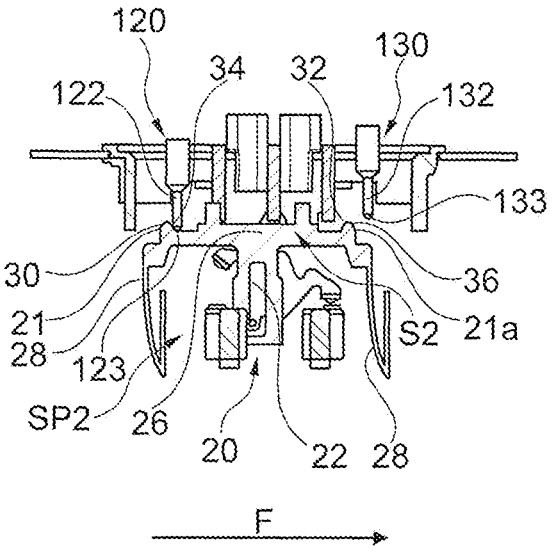
Figure 30:
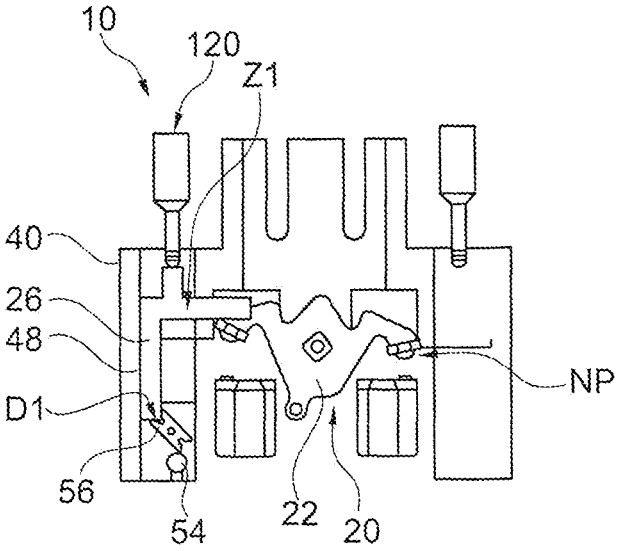
FIGS. 30 to 36 show the switch assembly with a mechanical switch and an electromechanical actuator unit according to a fourth embodiment example.
Figure 31:
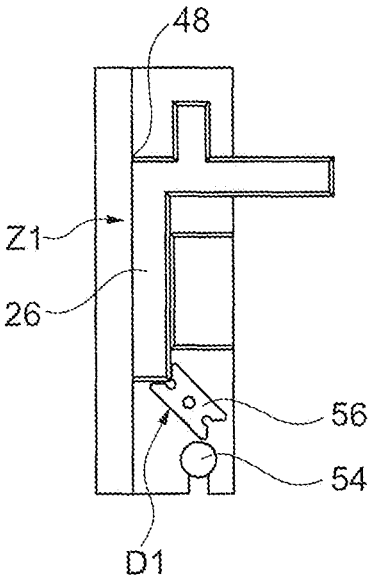
Figure 32:
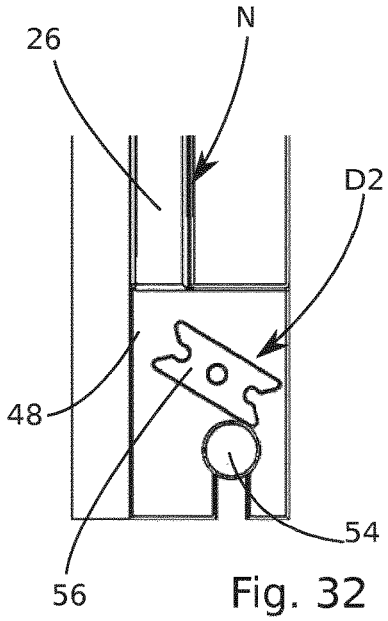
Figure 33:
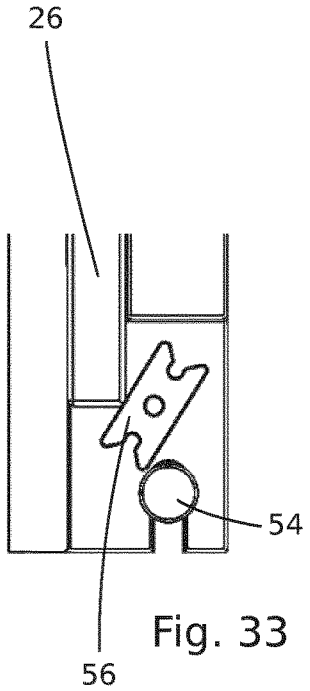
Figure 34:
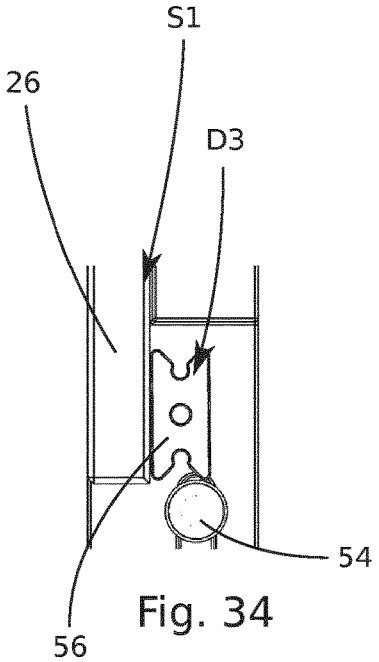
Figure 35:
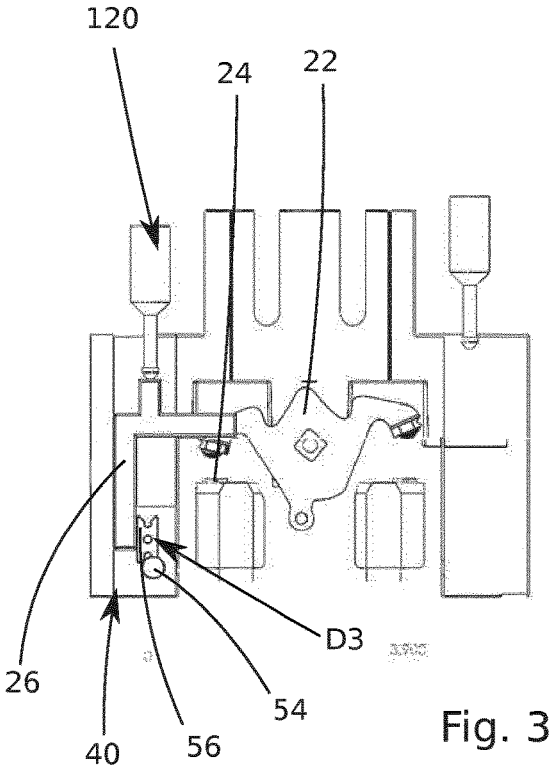
Figure 36:
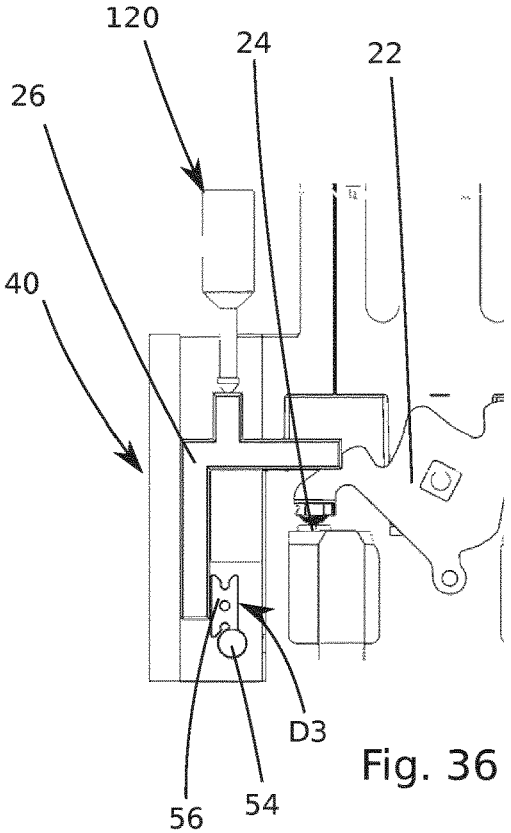

The second interim position Z2 is for example reproduced in FIG. 26. The head 133 of the second tappet 132 is connected with the second arresting means 21*a* here. At the same time the head 123 of the first tappet 122 is connected with the first arresting means 21 in the first interim position Z1.

In the first interim position Z1 the first actuator 120 can be deactivated, so that the first tappet 122 is moved against the movement direction M1 of the first tappet 122 when the head 123 of the first tappet 122 leaves the first arresting means 21.

In the second interim position Z2 the second actuator 130 can be deactivated in the same way, so that the tappet 132 is moved against the movement direction M2 of the second tappet 132 when the head 133 of the second tappet 132 leaves the second arresting means 21*a*.

The first target surface 30, the second target surface 32 and the first arresting means 21 are preferably arranged and designed in such a way that a movement of the head 123 of the first tappet 122 effects a movement of the carriage 26 from the neutral position N to interim position Z1 and a movement of the second tappet 132 following the same effects a disconnection of the connection between the head 123 of the first tappet 122 and the first arresting means 21, and a movement of the carriage 26 from the first interim position Z1 to the first switching position S1 is effected.

In a further preferred design of the mechanical switch 10 according to the fourth embodiment example reproduced in FIGS. 30 to 36 the base carrier 40 can further comprise a spring device 54 and a rotatable abutment element 56. The carriage is suitable for adopting a first switching position S1 and a first interim position Z1 here, which is arranged between the neutral position and the first switching position S1. The abutment element 56 can be suitable for adopting a starting position I, a first rotation position D1, a second rotation position D2 and a third rotation position D3. The spring device 54 can be designed for applying a force on the abutment element 56 at least in part.

The spring deflection of the spring device 54 is preferably limited in the direction of the abutment element 56.

The abutment element 56 can form an abutment for the carriage 26 in the first interim condition Z1 in the first rotation position D1.

The abutment element 56, the spring device 54 and the carriage 26 can be designed in such a way

- that the first abutment element 56 is transferred from the first rotation position D1 into the second rotation position D2 during a movement of the carriage 26 from the first interim position Z1 into neutral position N,
- that the carriage 26 can be transferred from the neutral position N into the first switching position S1 when the abutment element 56 adopts the second rotation position D2,
- that the abutment element 56 is transferred from the second rotation position D2 into the third rotation position D3 during a movement of the carriage 26 from the neutral position N into the first switching position S1,
- that the abutment element is transferred from the third rotation position D3 into the starting position I during a movement of the carriage 26 from the first switching position S1 into the neutral position N.

This design allows the switching of a monostable or bistable switching contact assembly 20 in a simple way. Only one actuator 120, 130 is preferably required for actuating the carriage 26 by means of the electronic actuator unit 100 here.

The electromechanical actuator unit 100 is suitable to be received in the holding device 50 of the mechanical switch 10 for supplying the electromechanical actuator unit 100 with voltage for effecting a state change of the switching contact assembly 20 of the mechanical switch 10 by means of the electromechanical actuator unit 100 independently of an external mechanical action on the operating mechanism 60 of the mechanical switch 10.

The electromechanical actuator unit 100 can comprise an interface 104, with which a connection with an input/output unit fitted to the mechanical switch 10 can be realised. Alternatively or additionally the electromechanical actuator unit 100 can comprise a radio interface for transmitting and/or receiving radio signals.

The switch assembly according to the invention comprises a mechanical switch 10 and an electromechanical actuator unit 100, wherein the electromechanical actuator unit 100 is received in the holding device 50 of the mechanical switch 10.

The invention also relates to a method for controlling a switch 10, in particular an electromechanical switch 10 according to the invention. For this the switch is preferably equipped with an electromechanical actuator unit 100, which is received in the holding device 50 of the mechanical switch 10.

The switch 10 comprises a switching contact assembly 20, in particular a monostable, bistable or tristable switching contact assembly, and a base carrier 40, in which the switching contact assembly 20 is received. The electromechanical actuator unit 100 can comprise a first actuator 120 with a first tappet 122 and a second actuator 130 with a second tappet 132. The switching contact assembly 20 comprises at least one rotatably mounted rocker switch 22 and at least one first switching contact 24. The base carrier 40 further comprises a guide arrangement 22 and the switching contact assembly 22 has a carriage, which can be mounted to move along and/or against a guide direction F in the guide arrangement 42. As described above the carriage 26 has a first target surface 30 and a second target surface, which can be brought into contact with the respective first tappet 122 and the second tappet 132.

The method is characterised by the following method steps:

Controlling the first actuator 120 for bringing the first tappet 122 into contact with the first target surface 30 and for transferring the carriage 26 along a guide direction F from a neutral position N into a first interim position Z1 and for effecting a transfer of the rocker switch 22 from a neutral position NP into a first interim position ZP1;

controlling the second actuator 130 for bringing the second tappet 132 into contact with the second target surface 32 and for transferring the carriage 26 along a guide direction F from the first interim position Z1 into a first switching position S1 and for effecting a transfer of the rocker switch 22 from the first interim position ZP1 into a first switching position SP1.

The switching contact assembly 20 can have at least one second switching contact 24 and the carriage a third target surface 34 and a fourth target surface 36 as described previously.

The method can be characterised by the following further method steps here:

Controlling the second actuator for bringing the second tappet 132 into contact with the fourth target surface 36 and for transferring the carriage 26 against guide direction F from the neutral position N into a second interim position Z2 and for effecting a transfer of the rocker switch 22 from a neutral position NP into a first interim position ZP2;

controlling the first actuator 120 for bringing the first tappet 122 into contact with the third target surface 34 and for transferring the carriage 26 against guide direction F from the second interim position Z2 into the second switching position S2 and for effecting a transfer of the rocker switch 22 from the second interim position ZP2 into the second switching position SP2.

The carriage can comprise a first arresting means 21 and/or a second arresting means 21*a*. The first tappet 122 can have a head and/or the second tappet 123 can have a head 133.

The method can be characterised by the following further method steps:

Connecting the first arresting means 21 with the head 123 of the first tappet 122 in the first interim position ZP1 for holding the carriage 26 in the first interim position ZP1 and/or for holding the head 123 of the first tappet 122 in the first arresting means 21; and/or connecting the second arresting means 21*a* with the head 133 of the second tappet 132 in the second interim position ZP2 for holding the carriage 26 in the second interim position ZP2 and/or for holding the head 133 of the second tappet 132 in the second arresting means 21*a*.

The rocker switch 22 can be in contact with the first switching contact 24 in the first switching position SP1 and be located at a distance from the first switching contact 24 in the neutral position NP. The rocker switch 22 can be in contact with the second switching contact 24*a* in the second switching position SP2 and be located at a distance from the second switching contact 24*a* in the neutral position NP. The carriage 26 can be mechanically uncoupled from the rocker switch 22 in the neutral position N.

The invention is of course not limited to the embodiments described and illustrated. Changes, for example in the embodiments of the various components or replacements with technical equivalents are possible at any time as long as they remain within the claimed scope of protection.

The invention claimed is:

1. Mechanical switch, in particular any one of a light switch, a roller shutter switch, and a thermostat switch, comprising:

a switching contact assembly, in particular a monostable, bistable or tristable switching contact assembly, and a base carrier, in which the switching contact assembly is received, wherein the base carrier further comprises a guide means, wherein the mechanical switch comprises an operating mechanism, which is guided in the guide means and is suitable for adopting an operating position following an external mechanical action for effecting a state change of the switching contact assembly and for adopting a resting position in the absence of the external mechanical action, wherein the base carrier further has a holding device for receiving an electromechanical actuator unit, which is designed in such a way that an electromechanical actuator unit received in the holding device can be supplied with voltage for to effect a state change of the switching contact assembly by means of the electromechanical actuator unit independently of an external mechanical action on the operating mechanism, wherein the switching contact assembly is uncoupled from the operating mechanism when the operating mechanism adopts the resting position, wherein the guide means comprises at least one linear guide element for the linear guiding of the operating mechanism and/or at least one rotatory guide element for the rotational guiding of the operating mechanism, wherein the linear guide element is designed as a slot open on one side or as an elongated hole and/or the rotatory guide element is designed as an opening or blind hole with a respective circular cross-section, wherein the base carrier further comprises a guide arrangement and the switching contact assembly comprises a carriage that is mounted to move along and/or against a guide direction in the guide arrangement, wherein the carriage is suitable for adopting a neutral position, in which the carriage is mechanically uncoupled from a rocker switch, and wherein at least one spring element, which is connected with the base carrier and the carriage in such a way that the spring element applies a force to the carriage, with which the carriage can be transferred from a first switching position and/or a second switching position and/or a first interim position and/or a second interim position into the neutral position.

2. The mechanical switch according to claim 1, wherein the switching contact assembly has at least one rocker switch rotatably mounted in the base carrier and at least one first switching contact, wherein the rocker switch is suitable for adopting a first switching position, in which the rocker switch is in contact with the first switching contact, and at least one neutral position, in which the rocker switch is located at a distance from the first switching contact.

3. The mechanical switch according to claim 1, wherein the carriage comprises a blocking element that is suitable for blocking the operating mechanism when the carriage lies outside of the neutral position.

4. The mechanical switch according to claim 1, wherein the base carrier further comprises a spring device and a rotatable abutment element, wherein the carriage is suitable for adopting a first switching position and a first interim position arranged between the neutral position and the first switching position, and the abutment element is suitable for adopting a starting position, a first rotation position, a second rotation position and a third rotation position, wherein the spring device applies a force onto the abutment element at least in part, wherein the abutment element, the spring device and the carriage are designed in such a way that the carriage can be transferred from the neutral position into the first interim position when the abutment element adopts the starting position, wherein the abutment element, the spring device and the carriage are designed in such a way that the abutment element is transferred from the neutral position into the first interim position during a movement of the carriage from the starting position into the first rotation position, wherein the abutment element forms an abutment for the carriage in the first interim position in the first rotation position, wherein abutment element, the spring device and the carriage are designed in such a way that the abutment element is transferred from the first interim position into the neutral position during a movement of the carriage from the first rotation position into the second rotation position, wherein the abutment element, the spring device and the carriage are designed in such a way that the carriage can be transferred from the neutral position into the first switching position when the abutment element adopts the second rotation position, wherein the abutment element, the spring device and the carriage are designed in such a way that the abutment element is transferred from the second rotation position into the third rotation position during a movement of the carriage from the neutral position into the first switching position, and wherein the abutment element, the spring device and the carriage are designed in such a way that the abutment element is transferred from the third rotation position into the starting position during a movement of the carriage from the first switching position into the neutral position.

5. The mechanical switch according to claim 1, wherein the holding device comprises a first plug-in connection means which can be connected with a second plug-in connection means of the electromechanical actuator unit for supplying the electromechanical actuator unit received in the holding device with voltage.

6. The mechanical switch according to claim 5, wherein the first plug-in connection means is designed as a socket and the second plug-in connection means as a plug.

7. An electromechanical actuator unit for a mechanical switch according to claim 1, wherein the electromechanical actuator unit is suitable for being received in the holding device of the mechanical switch for supplying the electromechanical actuator unit with voltage, and for effecting a state change of the switching contact assembly of the mechanical switch by means of the electromechanical actuator unit independently of an external mechanical action on the operating mechanism of the mechanical switch.

8. A switch assembly comprising a mechanical switch and an electromechanical actuator unit according to claim 7, wherein the electromechanical actuator unit is received in the holding device.

9. The mechanical switch according to claim 1, wherein the carriage has a first target surface that is suitable for being brought into contact with a first tappet of a first actuator of the electromechanical actuator unit received in the holding device for moving the carriage along the guide direction and effecting a state change of the switching contact assembly in this way.

10. The mechanical switch according to claim 9, wherein the carriage has a second target surface that is suitable for being brought into contact with a second tappet of a second actuator of the electromechanical actuator unit received in the holding device for displacing the carriage along the guide direction and thus effecting a state change of the switching contact assembly.

11. The mechanical switch according to claim 10, wherein the first target surface and the second target surface are designed in such a way that a successive movement of the first tappet and the second tappet effect a movement of the carriage from the neutral position into a first switching position.

12. The mechanical switch according to claim 9, wherein the carriage comprises a first arresting means adjacent to the first target surface, which can be connected with a head of the first tappet for holding the carriage in a first interim position, wherein the first arresting means is arranged in such a way that the head of the first tappet is suitable for sliding along the first target surface up to first arresting means for connecting the head of the first tappet with the first arresting means in the first interim position.

13. The mechanical switch according to claim 12, wherein the first target surface and the second target surface are designed in such a way that a successive movement of the first tappet and the second tappet effect a movement of the carriage from the neutral position into a first switching position, and wherein the first target surface, the second target surface and the first arresting means are arranged in such a way that a movement of the head of the first tappet effects a movement of the carriage from then neutral position into the first interim position and that a subsequent movement of the second tappet effects a disconnection of the connection between the head of the first tappet and the first arresting means and a movement of the carriage from the first interim position into a first switching position.

14. A method for controlling a switch, wherein the switch comprises a switching contact assembly, in particular a monostable, bistable or tristable switching contact assembly, a base carrier, in which the switching contact assembly is received, and an electromechanical actuator unit, wherein the base carrier comprises a holding device, in which the electromechanical actuator unit is received, wherein the electromechanical actuator unit comprises a first actuator with a first tappet and a second actuator with a second tappet, wherein the switching contact assembly has at least one rotatably mounted rocker switch and at least one first switching contact, wherein the base carrier further comprises a guide arrangement and the switching contact assembly comprises a carriage that is mounted to move along and/or against a guide direction in the guide arrangement, wherein the carriage has a first target surface that is suitable for being brought into contact with the first tappet of the first actuator of the electromechanical actuator unit received in the holding device, and wherein the carriage has a second target surface that is suitable for being brought into contact with the second tappet of the second actuator of the electromechanical actuator unit received in the holding device, wherein the method includes the steps of:

controlling the first actuator for bringing the first tappet into contact with the first target surface and for transferring the carriage along a guide direction from a neutral position into a first interim position and for effecting a transfer of a rocker switch from a neutral position into a first interim position;

controlling the second actuator for bringing the second tappet into contact with the second target surface and for transferring the carriage along a guide direction from the first interim position into a first switching position and for effecting a transfer of the rocker switch from the first interim position into a first switching position, wherein the carriage has a first arresting means and/or a second arresting means, and wherein the first tappet has a head and/or the second tappet has a head, wherein the method further includes the steps of:

connecting the first arresting means with the head of the first tappet in the first interim position for holding the carriage in the first interim position and/or for holding the head of the first tappet in the first arresting means; and/or connecting the second arresting means with the head of the second tappet in the second interim position for holding the carriage in the second interim position and/or for holding the head of the second tappet in the second arresting means.

15. The method according to claim 14, wherein the switching contact assembly has at least one second switching contact, wherein the carriage has a third target surface that is suitable for being brought into contact with the first tappet of the first actuator of the electromechanical actuator unit received in the holding device, and wherein the carriage has a fourth target surface that is suitable for being brought into contact with the second tappet of the second actuator of the electromechanical actuator unit received in the holding device, wherein the method includes the additional steps of:

controlling the second actuator for bringing the second tappet into contact with the fourth target surface and for transferring the carriage against a guide direction from neutral position into a second interim position and for effecting a transfer of the rocker switch from a neutral position into a second interim position;

controlling the first actuator for bringing the first tappet into contact with the third target surface and for transferring the carriage against a guide direction from the second interim position into a second switching position and for effecting a transfer of the rocker switch from the second interim position into a second switching position.

16. The method according to claim 14, wherein the rocker switch is in contact with the first switching contact in the first switching position and is located at a distance from the first switching contact in the neutral position and/or that the rocker switch is in contact with the second switching contact in the second switching position and is located at a distance from the second switching contact in the neutral position and/or that the carriage is mechanically uncoupled from the rocker switch in the neutral position.

* * * * *